United States Patent [19]

Takeda

[11] 4,315,491

[45] Feb. 16, 1982

[54] FUEL INJECTION TYPE INTERNAL COMBUSTION ENGINE

[75] Inventor: Keiso Takeda, Susono, Japan

[73] Assignee: Toyota Jidosha Kogyo Kabushiki Kaisha, Toyota, Japan

[21] Appl. No.: 65,563

[22] Filed: Aug. 10, 1979

[30] Foreign Application Priority Data

Jan. 23, 1979 [JP] Japan ..... 54/5535

[51] Int. Cl.[3] ..... F02M 51/00

[52] U.S. Cl. ..... 123/478; 123/445; 123/491; 123/492

[58] Field of Search ..... 123/478, 470, 445, 472, 123/491, 492

[56] References Cited

U.S. PATENT DOCUMENTS

| | | | |
|---|---|---|---|
| 3,677,236 | 7/1972 | Moss | 123/491 |
| 3,868,936 | 3/1975 | Rivere | 123/445 |
| 4,050,878 | 9/1977 | Priegel | 123/478 |
| 4,096,831 | 6/1978 | Gunda | 123/491 |
| 4,140,088 | 2/1979 | de Vulpillieres | 123/478 |
| 4,159,697 | 7/1979 | Sweet | 123/478 |
| 4,159,703 | 7/1979 | Mayer | 123/478 |
| 4,186,708 | 2/1980 | Bowler | 123/445 |
| 4,216,753 | 8/1980 | Inoue et al. | 123/445 |
| 4,242,992 | 1/1981 | Kawamura et al. | 123/491 |

FOREIGN PATENT DOCUMENTS

| | | | |
|---|---|---|---|
| 950776 | 2/1964 | United Kingdom | 123/470 |

*Primary Examiner*—Charles J. Myhre
*Assistant Examiner*—Andrew M. Dolinar
*Attorney, Agent, or Firm*—Kenyon & Kenyon

[57] ABSTRACT

An internal combustion engine with a vertically extending intake duct leading to the collecting portion of the intake manifold and a throttle valve in the intake duct has a main fuel injector and an auxiliary fuel injector arranged in the intake duct downstream of the throttle valve. An amount of fuel which is proportional to the amount of the sucked air is intermittently injected into the intake duct from the main fuel injector. At least a fixed small amount of fuel is in effect continuously injected from the auxiliary fuel injector, with additional amounts being temporarily supplied during engine startup and acceleration.

17 Claims, 6 Drawing Figures

FUEL INJECTION TYPE INTERNAL COMBUSTION ENGINE

BACKGROUND OF THE INVENTION

The present invention relates to a fuel injection type internal combustion engine.

As an internal combustion engine of a gasoline injection type, there has been known an engine in which gasoline is intermittently injected from a fuel injector in an amount proportional to an amount of the sucked air and, in addition, the intermittent injecting operation of the fuel injector is carried out in synchronization with the rotating operation of the engine. However, in such an engine, since the intermittent injecting operation of the fuel injector is carried out in synchronization with the rotating operation of the engine, the time interval between a given injecting operation and the successive injecting operation becomes long when both the speed of the engine and the amount of the sucked air are reduced, as in the case wherein the engine is operating in an idling condition. As a result of this, since the stream of the fuel injected from the fuel injector becomes more discontinuous, the irregularity in the air-fuel ratio in each cylinder becomes large and, thus, a problem occurs in that a stable combustion cannot be ensured. In addition, in the case wherein the fuel is intermittently injected from the fuel injector, it is impossible to instantaneously increase the amount of the fuel injected from the fuel injector when such an instantaneous increase in the amount of the fuel injected from the fuel injector is necessary, as in the case where the engine is accelerated. As a result of this, since the amount of the fuel injected from the fuel injector is not instantaneously increased in response to the depression of the accelerator pedal, a problem occurs in that a good responsiveness of the engine to the depression of the accelerator pedal cannot be obtained.

SUMMARY OF THE INVENTION

According to the present invention, there is provided a fuel injection type internal combustion engine comprising: an engine body; an intake duct fixed onto said engine body and defining an intake passage therein; a throttle valve arranged in said intake passage; a first fuel injector having a fuel nozzle arranged in said intake passage; a second fuel injector having a fuel nozzle arranged in said intake passage, and; injection control means for controlling the injecting operation of said first and second fuel injectors so as to always maintain the amount of fuel injected from said first fuel injector approximately constant and increase the amount of fuel injected from said second fuel injector in accordance with an increase in the amount of a sucked air.

The present invention may be more fully understood from the description of a preferred embodiment of the invention set forth below, together with the accompanying drawings.

DESCRIPTION OF A PREFERRED EMBODIMENT

Figure 1:
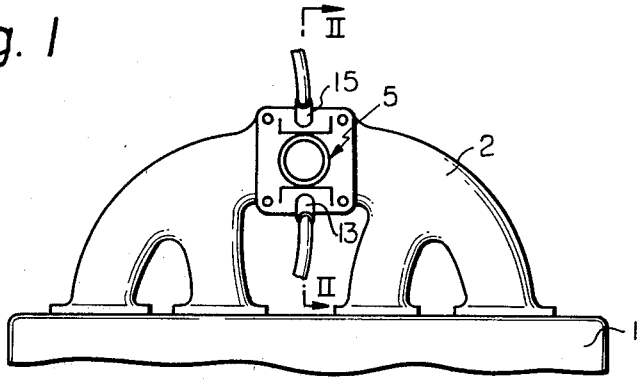
FIG. 1 is a plan view of a part of an internal combustion engine according to the present invention.
Figure 2:
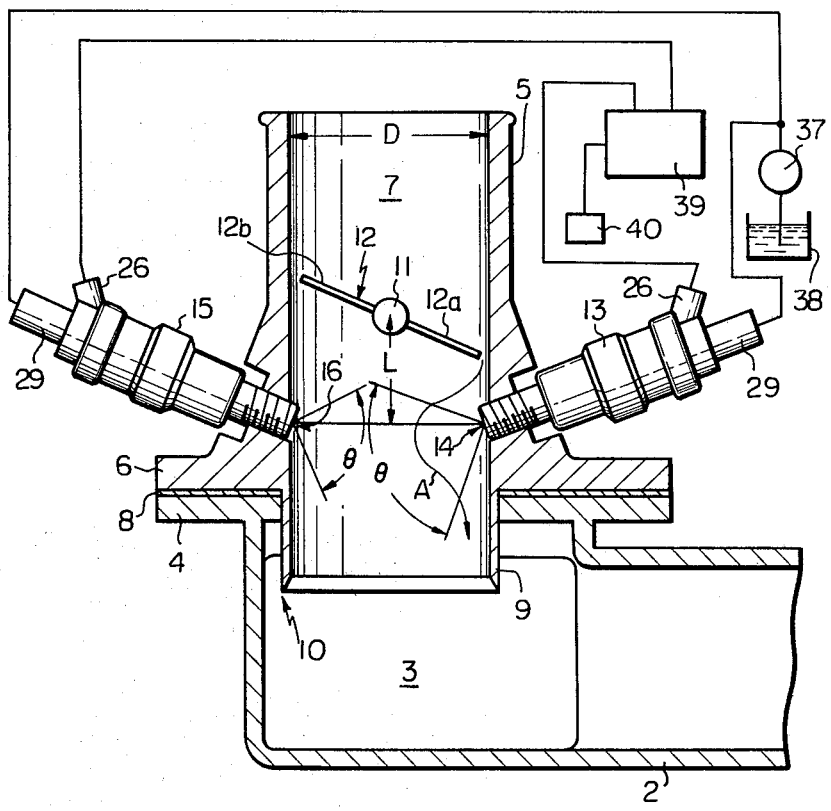
FIG. 2 is a cross-sectional side view taken along the line II—II in FIG. 1.

Referring to FIGS. 1 and 2, 1 designates an engine body, 2 an intake manifold fixed onto the engine body 1 and 3 a collecting portion of the intake manifold 2; 4 designates a horizontally extending manifold flange formed in one piece on the intake manifold 2 and arranged above the collecting portion 3, and 5 an approximately cylindrical intake duct having a mounting flange 6 which is formed in one piece of the lower end of the intake duct 5. A cylindrical intake passage 7 extending vertically and having a substantially uniform cross-section is formed in the intake duct 5. As illustrated in FIG. 2, the mounting flange 6 of the intake duct 5 is fixed onto the manifold flange 4 via a gasket 8, and a cylindrical member 9 having a thin wall and projecting downwards into the collecting portion 3 of the intake manifold 2 is formed in one piece on the lower end of the intake duct 5. The lower end 10 of the cylindrical member 9 has a knife edge shape and is arranged so as to be spaced from the peripheral side wall of the collecting portion 3 of the intake manifold 2. A throttle shaft 11 extending in parallel with the longitudinal axis of the engine body 1 (FIG. 1) is arranged in the intake passage 7, and a throttle butterfly valve 12, which is fixed onto the throttle shaft 11. For the sake of later explanation, hereinafter, the downstream side of the throttle valve 12, which is located at a position near the engine body 1 (FIG. 1) with respect to the throttle shaft 11, is referred to as a right valve plate 12*a*, and the upstream side of the throttle valve 12, which is located at a position remote from the engine body 1 (FIG. 1) with respect to the throttle shaft 11, is referred to as a left valve plate 12*b*. The throttle shaft 11 of the throttle valve 12 is connected to the accelerator pedal (not shown), so that the throttle valve 12 is rotated in the clockwise direction when the accelerator pedal is depressed. A swirl type main fuel injector 13 is arranged on the inner wall of the intake passage 7 at a position downstream of the throttle valve 12 and near the engine body 1 (FIG. 1). As illustrated in FIG. 2, the main fuel injector 13 is so arranged that a fuel nozzle 14 thereof is directed slightly downwards, and that the distance L between the fuel nozzle 14 and the throttle shaft 11 is less than one half of the diameter D of the intake passage 7. In addition, a swirl type auxiliary fuel injector 15 is arranged on the inner wall of the intake passage 7 at a position opposite to the main fuel injector 13. The auxiliary fuel injector 15 is so arranged that a fuel nozzle 16 thereof is positioned at a level which is almost the same as the level of the fuel nozzle 14 of the main fuel injector 13, and that the fuel nozzle 16 is directed slightly downwards. The auxiliary fuel injector 15 has a construction which is the same as that of the main fuel injector 13. Consequently, the construction of the swirl type fuel injectors 13, 15 will be hereinafter described with reference to the main fuel injector 13.

Figure 4:
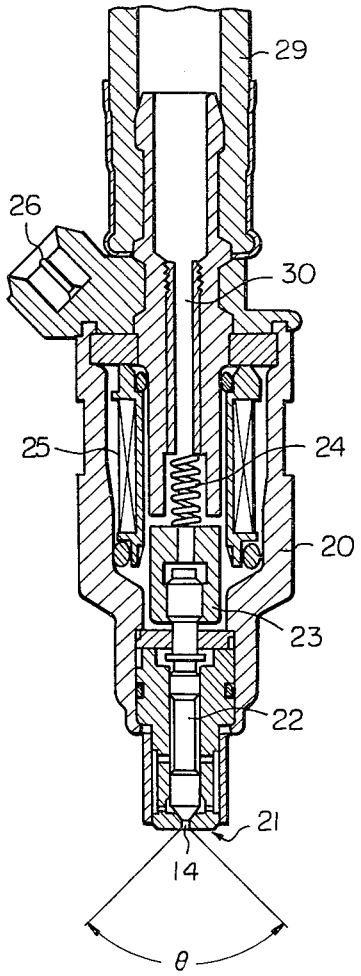
FIG. 4 is a cross-sectional side view of the fuel injector illustrated in FIG. 2.
Figure 5:
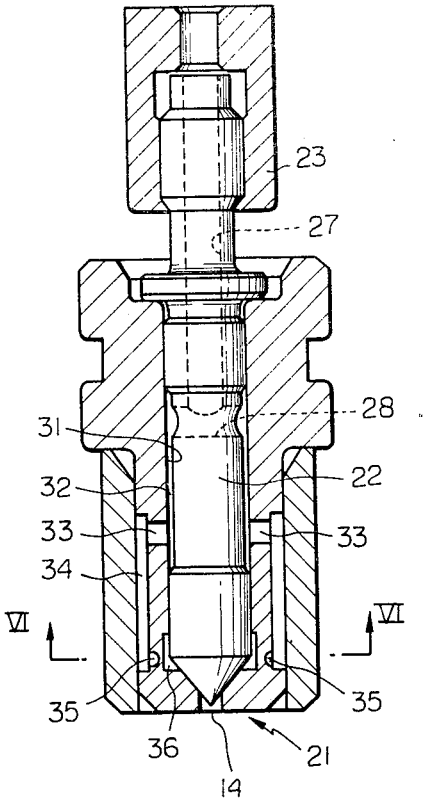
FIG. 5 is an enlarged cross-sectional side view of a part of the fuel injector illustrated in FIG. 4.
Figure 6:
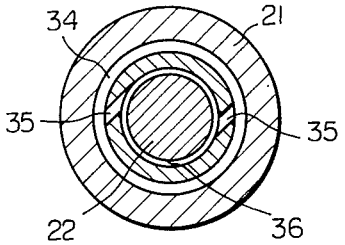
FIG. 6 is a cross-sectional view taken along the line VI—VI in FIG. 5.

Referring to FIGS. 4 and 5, reference numeral 20 designates an injector housing, 21 a valve holder fixed onto the tip of the housing 20, 22 a needle reciprocally movable within the valve holder 21 for controlling the opening operation of the fuel nozzle 14 and 23 a movable core fixed onto the upper end of the movable needle 22; 24 designates a compression spring for biasing the movable needle 22 towards the fuel nozzle 14, 25 a solenoid for attracting the movable core 23 and 26 a connector for supplying the solenoid 25 with electric power. As illustrated by the broken line in FIG. 5, an axial bore 27 and a radial bore 28 are formed within the movable needle 22. Consequently, the fuel fed into a fuel passage 30 (FIG. 4) from a fuel conduit 29 is fed via the axial bore 27 and the radial bore 28 into an annular chamber 32 formed between the movable needle 22 and a cylindrical inner wall 31 of the valve holder 21. As illustrated in FIGS. 5 and 6, the annular chamber 32 is connected to a swirl chamber 36 via a pair of radial bores 33, an annular chamber 34 and a pair of fuel ports 35. On the other hand, as illustrated in FIG. 2, both the fuel conduits 29 of the main fuel injector 13 and the auxiliary fuel injector 15 are connected to a fuel tank 38 via a fuel pump 37. In addition, both the connectors 26 of the solenoids 25 of the main fuel injector 13 and the auxiliary fuel injector 15 are connected to an electronic control circuit 39 for controlling the injecting operation of the main fuel injector 13 and the auxiliary fuel injector 15.

Turning to FIGS. 4 and 5, when the solenoid 25 is energized in response to the output signal of the electronic control circuit 39 (FIG. 2) and, as a result, the movable needle 22 opens the fuel nozzle 14, the fuel fed into the annular chamber 32 from the fuel conduit 29 flows into the swirl chamber 36 via the radial bores 33, the annular chamber 34 and the fuel ports 35, and then, the fuel is injected from the fuel nozzle 14. As illustrated in FIG. 6, both the fuel ports 35 are tangentially connected to the circumferential inner wall of the swirl chamber 36. Consequently, when the movable needle 22 opens the fuel nozzle 14, a strong swirl motion of the fuel is created in the swirl chamber 36 by the fuel flowing into the swirl chamber 36 from the fuel ports 35. Then, the swirling fuel in the swirl chamber 36 is injected, while swirling, from the fuel nozzle 14 and, as a result, the fuel injected from the fuel nozzle 14 spreads as illustrated in FIG. 4 due to the centrifugal force caused by the swirling motion. As mentioned above, in the swirl type fuel injectors 13, 15 as illustrated in FIG. 2, since the fuel injected from the fuel injectors 13, 15 spreads while swirling, the atomization of the fuel is strongly promoted. In addition, in the case wherein the fuel injectors 13, 15 are arranged as illustrated in FIG. 2, it has been proven that it is preferable that the injection angle shown by $\theta$ in FIGS. 2 and 4 be in the range of 60 through 120 degrees. In addition, it has been also proven that it is most preferable that the injection angle $\theta$ be equal to an approximate 90 degree.

Figure 3:
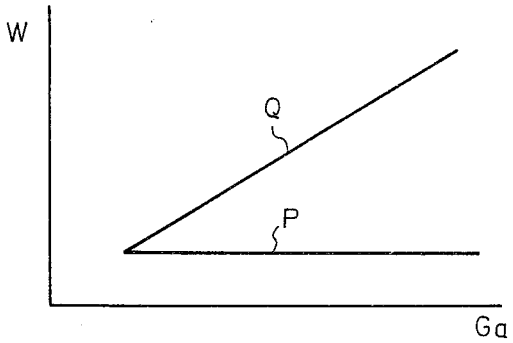
FIG. 3 is a graph showing changes in an amount of fuel injected from the fuel injector.

The injecting operation of the fuel injectors 13, 15 will be described hereinafter with respect to FIG. 3. In FIG. 3, the ordinate W indicates an amount of fuel injected from the fuel injectors 13, 15, and the abscissa $G_a$ indicates an amount of the sucked air. A small amount of the fuel, which is necessary to maintain the idling operation of the engine, is continuously injected from the auxiliary fuel injector 15. Consequently, as illustrated by the straight line P in FIG. 3, the amount W of the fuel injected from the auxiliary fuel injector 15 is maintained constant independent of the amount $G_a$ of the sucked air. Alternatively, instead of continuously injecting the fuel from the auxiliary fuel injector 15 as mentioned above, the fuel may be intermittently injected from the auxiliary fuel injector 15 at a time interval of about 20 m sec. However, in this case, since the above-mentioned time interval is extremely short, such an intermittent injecting operation can be considered to be a continuous injecting operation. In addition, for example, in the case wherein the fuel is intermittently injected from the auxiliary fuel injector 15, when the engine is accelerated, the amount W of the fuel injected from the auxiliary fuel injector 15 can be increased by elongating the length of time during which the injecting operation of the auxiliary fuel injector 15 is carried out, in response to the output signal of an acceleration detector 40 (FIG. 2) capable of detecting the acceleration of the engine. Furthermore, the amount W of the fuel injected from the auxiliary fuel injector 15 can be also increased when the engine is started.

On the other hand, an amount of fuel which is proportional to the amount of the sucked air is intermittently injected from the main fuel injector 13 in synchronization with the rotating operation of the engine, for example, every time the engine rotates by a crank angle of 180 degrees. Consequently, as illustrated by the straight line Q in FIG. 3, the amount W of the fuel injected from the main fuel injector 13 is proportional to the amount $G_a$ of the sucked air. The amount of the fuel injected from the main fuel in injector 13 is corrected on the basis of the output signal of the oxygen concentration detector (not shown) arranged in the exhaust system of the engine, on the basis of the output signal of the temperature detector (not shown) used for detecting the temperature of the sucked air and on the basis of the output signal of the pressure detector (not shown) used for detecting the ambient atmospheric pressure, so that the air-fuel ratio of the mixture fed into the cylinder of the engine becomes precisely equal to a predetermined ratio.

From FIG. 3, it will be understood that when the engine is operating in an idling condition, the fuel is fed only from the auxiliary fuel injector 15. At this time, since the fuel injected from the auxiliary fuel injector 15 spreads while swirling as mentioned previously, a good atomization of the fuel can be ensured. In addition, since the fuel is continuously injected or intermittently injected at an extremely short time interval from the auxiliary fuel injector 15, the distribution of fuel to each cylinder becomes uniform. As a result, a stable idling operation of the engine can be ensured. From FIG. 3, it will be understood that when the amount $G_a$ of the sucked air is increased, that is, when the throttle valve 12 (FIG. 2) is opened, the injecting operation of the main fuel injector 13 is started.

When the opening degree of the throttle valve 12 is small, as illustrated in FIG. 2, and thus the engine is operating under a light load, observations using the schlieren photography process have demonstrated that the velocity of the air flowing between the right valve plate **12*a* and the inner wall of the intake passage 7 is higher than that of the air flowing between the left valve plate 12*b* and the inner wall of the intake passage 7, and that the air stream which has passed between the right valve plate 12*a* and the inner wall of the intake passage 7 moves downwards towards the center of the intake passage 7, away from the inner wall, and then again approaches and flows down along the inner wall of the intake passage 7, as shown in FIG. 2. Consequently, by positioning the fuel nozzle 14 of the main fuel injector 13 below the throttle shaft 11 by the distance L, the main fuel injected from the main fuel injector 13 is carried towards the central portion of the intake passage 7 by the air stream flowing as illustrated by the arrow A in FIG. 2. As a result, the main fuel injected from the main fuel injector 13 is uniformly distributed within the intake passage 7. In addition, by using the swirl type main fuel injector 13, the atomization of the fuel is promoted. Furthermore, since the main fuel injector 13 is arranged directly below of the right valve plate 12***a*, the main fuel injected from the main fuel nozzle 13 is divided into fine droplets by the higher speed air stream passing around the right valve plate, and thus the atomization of the main fuel is further promoted. The fuel thus divided into the fine droplets then flows into the collecting portion 3 of the intake manifold 2 together with the sucked air. At this time, the liquid fuel adhering onto the inner wall of the intake passage 7 and flowing downwards along the inner wall of the intake passage 7 is sheared into fine droplets at the knife edge shape lower end 10 of the cylindrical member 9, thus promoting the atomization of the liquid fuel adhering onto the inner wall of the intake passage 7. After this, the fuel flows into the collecting portion 3, through the intake manifold 2 and then is fed into the cylinders of the engine. Since the atomization and the vaporization of the fuel are promoted when the fuel injected from the fuel injectors 13, 15 flows into the collecting portion 3 of the intake manifold 2, the distribution of the fuel to each cylinder becomes uniform. In addition, since the fuel injected from the fuel injectors 13, 15 is immediately fed into the cylinders of the engine, a good responsiveness of the injection control to the output signal of the oxygen concentration detector can be ensured.

As mentioned previously, when the engine is accelerated, the amount of the fuel injected from the auxiliary fuel injector 15 may be increased. Since the fuel is either continuously injected or intermittently injected at an extremely short time interval from the auxiliary fuel injector 15, the amount of the fuel injected from the auxiliary fuel injector 15 can be immediately increased as soon as the accelerator pedal is depressed, thus assuring good responsiveness of the engine to the depression of the accelerator pedal.

According to the present invention, since the distribution of the fuel to each cylinder is uniform, regardless of the operating condition of an engine, a stable combustion can be always obtained, particularly during idling operation of an engine. In addition, since the amount of the fuel injected from the auxiliary fuel injector can be immediately increased when necessary, as in the case when the engine is accelerated, a good responsiveness of the engine to the depression of the accelerator pedal can be ensured.

While the invention has been described by reference to a specific embodiment chosen for purposes of illustration, it should be apparent that numerous modifications could be made thereto by those skilled in the art without departing from the spirit and scope of the invention.

What is claimed is:

1. A fuel injection type of internal combustion engine having an engine body;

an intake duct fixed onto said engine body and defining an intake passage therein;

a throttle valve arranged in said intake passage;

a first fuel injector having a fuel nozzle arranged in said intake passage;

a second fuel injector having a fuel nozzle arranged in said intake passage; and injection control means for controlling the injecting operation of said first and second fuel injectors, wherein the improvement comprises:

said injection control means being arranged to control said first fuel injector so as to deliver fuel intermittently at a uniform cyclic rate, with each period of intermittent injection not exceeding about 20 m sec, to maintain a fixed predetermined amount of fuel injected from said first fuel injector under all steady state operating conditions of the warmed-up engine, and to control said second fuel injector so as to vary the amount of fuel injected from said second fuel injector as a direct function of the amount of intake air flow.

2. A fuel injection type of internal combustion engine according to claim 1, wherein said fixed predetermined amount of fuel injected from said first fuel injector is approximately equal to the amount of fuel which is necessary to maintain the idling operation of the warmed-up engine.

3. A fuel injection type of internal combustion engine according to claim 1, wherein the injection control means actuates the first fuel injector to increase the amount of fuel injected from said first fuel injector above said fixed predetermined amount when the engine is accelerated.

4. A fuel injection type of internal combustion engine according to claim 1, wherein the injection control means actuates the first fuel injector to increase the amount of fuel injected from said first fuel injector above said fixed predetermined amount when the engine is started.

5. A fuel injection type of internal combustion engine according to claim 1, wherein the injection control means actuates the second fuel injector such that the amount of fuel injected by said second fuel injector is proportional to the amount of the intake air flow and is intermittently injected from said second injector in synchronization with the rotation of the engine.

6. A fuel injection type of internal combustion engine according to claim 1, wherein said intake duct comprises an intake manifold, said manifold having a collecting portion, and an intake duct portion extending substantially vertically upward from said collecting portion, said throttle valve being arranged in said intake duct portion, and said first and second fuel injectors being arranged in said intake duct portion downstream of said throttle valve.

7. A fuel injection type of internal combustion engine according to claim 6, wherein the fuel nozzle of said first fuel injector is arranged opposite to the fuel nozzle of the second fuel injector with respect to the vertical axis of said intake duct portion.

8. A fuel injection type of internal combustion engine according to claim 7, wherein said throttle valve is a butterfly valve which has a throttle shaft extending horizontally and a valve plate having a downstream-opening side on one side of the valve shaft and an upstream-opening side on the opposite side of the valve shaft in parallel with a longitudinal axis of the engine body, the fuel nozzle of said first fuel injector being arranged at a position opposite to the fuel nozzle of said second fuel nozzle.

9. A fuel injection type of internal combustion engine according to claim 8, wherein the fuel nozzle of said first fuel injector is arranged on the same side of the intake duct portion as the upstream-opening side of the throttle valve plate, and the fuel nozzle of said second fuel injector is arranged on the same side of the intake duct portion as the downstream-opening side of the throttle valve plate.

10. A fuel injection type of internal combustion engine according to claim 8, wherein the fuel nozzle of said first fuel injector is at approximately the same level as the fuel nozzle of the second injector.

11. A fuel injection type of internal combustion engine according to claim 10, wherein the vertical distance between said level and said throttle shaft is less than one half the diameter of said intake passage.

12. A fuel injection type of internal combustion engine according to claim 7, wherein the fuel nozzles of said first and second fuel injectors are directed slightly downwards.

13. A fuel injection type of internal combustion engine according to claim 6, wherein said intake duct portion has a cylindrical lower end projecting downwards into said collecting portion and spaced from a circumferential wall of said collecting portion.

14. A fuel injection type of internal combustion engine according to claim 13, wherein said cylindrical lower end has a knife edge shape.

15. A fuel injection type of internal combustion according to claim 1, wherein said first and second fuel injectors are swirl type injectors.

16. A fuel injection type of internal combustion engine according to claim 15, wherein the injection spray angle of each of said first and second fuel injectors is in the range between 60 and 120 degrees.

17. A fuel injection type of internal combustion engine according to claim 16, wherein said injection spray angle is about 90 degrees.

* * * * *